United States Patent [19]

Gilvar

[11] Patent Number: 4,580,429

[45] Date of Patent: Apr. 8, 1986

[54] ROLLING MILL ROLL STAND WITH HYDRAULIC ROLL POSITION CONTROL

[75] Inventor: Martin Gilvar, Oakham, Mass.

[73] Assignee: Morgan Construction Company, Worcester, Mass.

[21] Appl. No.: 691,653

[22] Filed: Jan. 15, 1985

[51] Int. Cl.[4] ..... B21B 31/10

[52] U.S. Cl. ..... 72/238; 72/245

[58] Field of Search ..... 72/237, 238, 239, 245

[56] References Cited

U.S. PATENT DOCUMENTS

| | | | |
|---|---|---|---|
| 739,416 | 9/1903 | Hughes | 72/237 |
| 3,735,804 | 5/1973 | Wagner | 72/237 |
| 3,757,553 | 9/1973 | Greenberger | 72/238 |

FOREIGN PATENT DOCUMENTS

| | | | |
|---|---|---|---|
| 2263573 | 7/1974 | Fed. Rep. of Germany | 72/238 |

*Primary Examiner*—Francis S. Husar
*Assistant Examiner*—John M. Griffin
*Attorney, Agent, or Firm*—Thompson, Birch, Gauthier & Samuels

[57] ABSTRACT

A rolling mill roll stand has a housing removably mounted on a lower bridge. A pair of work rolls and their respective bearings and bearing chocks are contained within the housing. Separating devices act on the bearing chocks to maintain a gap between the work rolls. Hydraulic roll positioning cylinders are carried in the lower bridge and are arranged to act on the bearing chocks of one of the work rolls. The housing together with the work rolls, bearing chocks and separating devices is removable as a unit from the lower bridge, while allowing the hydraulic positioning cylinders to remain undisturbed.

11 Claims, 10 Drawing Figures

ROLLING MILL ROLL STAND WITH HYDRAULIC ROLL POSITION CONTROL

BACKGROUND OF THE INVENTION

1. Field of the Invention

This invention relates to rolling mill roll stands employing hydraulic roll position control systems.

2. Description of the Prior Art

Hydraulic roll position control systems have been employed in the past in 4-Hi strip mills (see Journal of the Iron and Steel Institute, April 1972, pp. 235–245). In this type of installation, the hydraulic roll positioning cylinders act on the bearing chocks of the backup rolls. When it becomes necessary to replace the work rolls, they and their respective bearings and bearing chocks are simply interchanged for a fresh set, while the roll housing and the backup rolls remain on the rolling line. This in turn allows the roll positioning cylinders and their hydraulic connections to the remainder of the hydraulic control system to remain undisturbed.

However, in 2-Hi mills of the type employed to roll bar products and the like, the situation is quite different. Here, the roll positioning devices must necessarily act directly on the bearing chocks of one of the work rolls. Also, work roll changes normally require an accompanying change and/or resetting of the entry and delivery guides. Thus, in order to minimize down-time, the preferred practice is to provide spare roll housings complete with fresh work rolls and pre-set guides. When a roll change is required, the on-line roll housings are removed and replaced by the spare housings.

Where the roll positioning devices comprise conventional electrically driven mechanical screwdowns, this exchange of housings does not present a problem. However, where the roll positioning devices are of the hydraulic type, an exchange of housings conventionally necessitates a breaking of hydraulic couplings in the lines connecting the roll positioning cylinders to the remainder of the hydraulic control system. When this is done, there is a danger that air may be introduced into the lines. Also, the hydraulic fluid may become contaminated by dirt, mill scale, etc. Either of these occurrences can seriously compromise the effectiveness of the hydraulic roll positioning system.

SUMMARY OF THE PRESENT INVENTION

The present invention provides a solution to these problems by permanently locating the hydraulic roll positioning cylinders in a lower bridge on which roll housings may be interchangeably mounted. The roll housings are adapted to carry pairs of work rolls and their respective bearing chocks, along with the entry and delivery guides. One housing may be exchanged for another without disturbing the hydraulic roll positioning cylinders and their connections to the remainder of the control system. Thus, the likelihood of entraining air into the hydraulic lines, or of contaminating the hydraulic fluid, is effectively obviated.

Several preferred embodiments of the invention will be described hereinafter in greater detail with reference to the accompanying drawings wherein:

DETAILED DESCRIPTION OF ILLUSTRATED EMBODIMENTS

Figure 1:
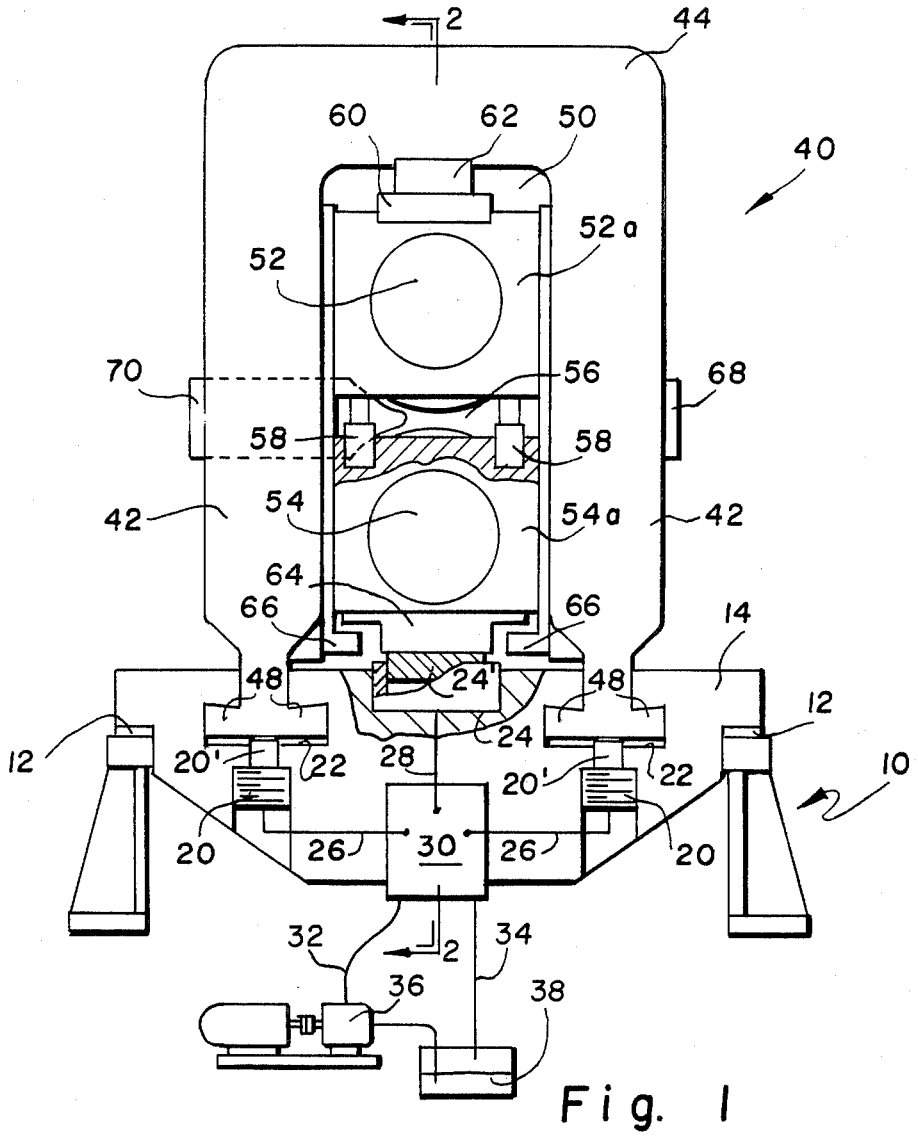
FIG. 1 is an end view of a horizontal rolling mill roll stand in accordance with the present invention, with certain parts broken away, and including a somewhat diagrammatic representation of a portion of the hydraulic control system for the roll positioning cylinders.
Figure 4:
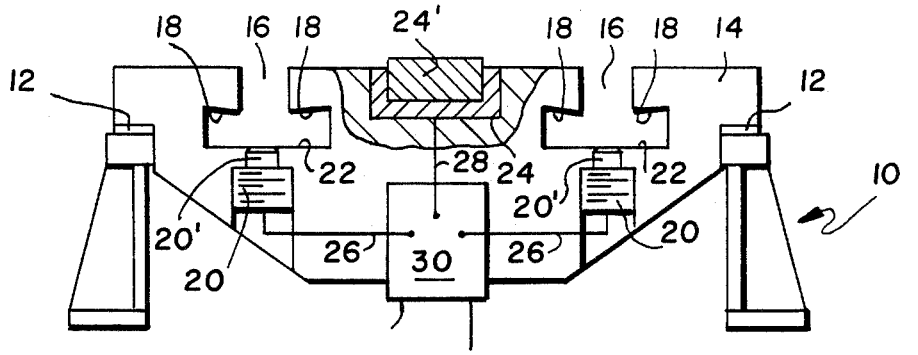
FIG. 4 is an end view of the lower bridge after the roll housing has beeen removed therefrom.
Figure 2:
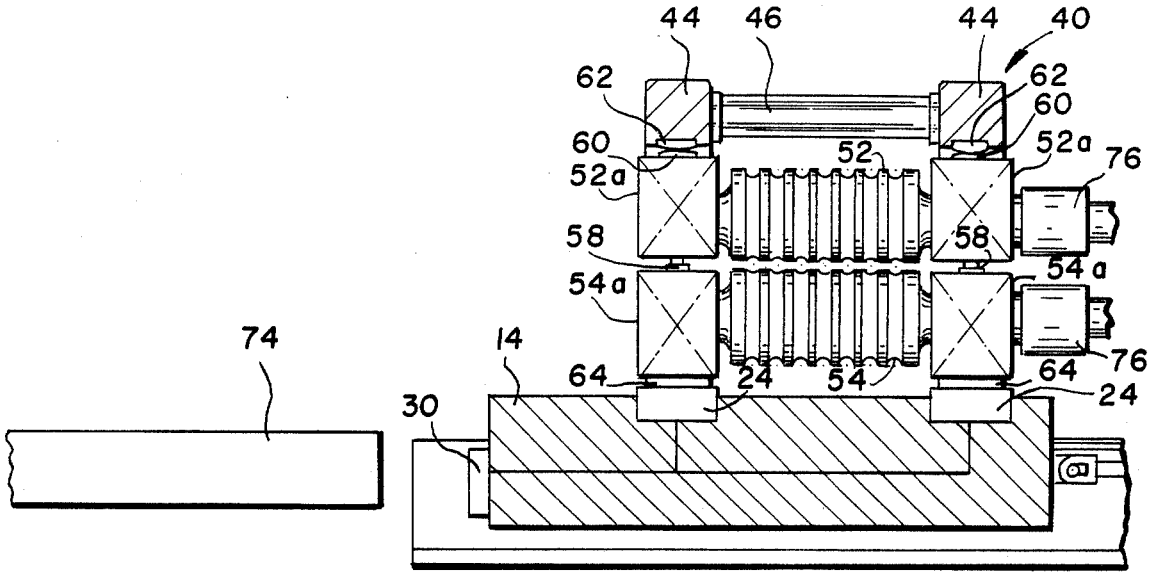
FIG. 2, is a sectional view on a reduced scale taken along line 2—2 of FIG. 1.

Referring initially to FIGS. 1–6, a horizontal rolling mill roll stand in accordance with the present invention is shown comprising a fixed bed 10 with horizontal rails 12 extending beneath and at right angles to the rolling line. A lower bridge 14 is slidably supported on the rails 12. Parallel channels 16 extend across the top of the bridge 14. As is best shown in FIG. 4, the channels are undercut as at 18. Hydraulic tightening cylinders 20 are located along the bottom surfaces 22 of the channels. Large diameter hydraulic roll positioning cylinders 24 are centrally located on the bridge between the channels 22. In the condition shown in FIG. 4, the pistons 20' of the tightening cylinders 20 are retracted beneath the bottom surfaces 22 of the channels 16, and the pistons 24' of the roll positioning cylinders 24 are also retracted to their lowermost positions.

The cylinders 20, 24 are respectively connected by hydraulic lines 26, 28 to a control panel 30 mounted on the base 14. The panel includes control valves (not shown) connected by flexible hydraulic pressure and return lines 32, 34 to a hydraulic pump 36 and a hydraulic fluid reservoir 38. The control panel 30, pump 36, reservoir 38 and associated fluid lines form part of a hydraulic control system which may be of conventional design known to those skilled in the art.

A roll housing 40 is adapted to be removably received on the base 14. The housing includes a pair of inverted U-shaped ends each having laterally spaced legs 42 joined by a bridging portion 44. The housing ends are rigidly interconnected by separators 46 extending between the bridging portions 44. The lower ends of the legs 42 are suitably configured to be received in the channels 16, with laterally extending ribs 48 arranged to underlie the undercut channel portions 18.

The bridging portions 44 and their depending legs 42 define housing windows 50 suitably dimensioned and configured to receive a pair of upper and lower work rolls 52, 54 along with their associated bearing chocks **52*a*, 54*a*** containing the roll neck bearings.

In order to maintain a gap 56 between the work rolls, separating means in the form of small hydraulic cylinders 58 are interposed between the upper and lower bearing chocks **52*a*, 54*a*. Preferably, the hydraulic cylinders 58 are connected to and controlled by a hydraulic control circuit (not shown) separate from that controlling the roll positioning cylinders 24. Alternatively, instead of employing hydraulic cylinders 58, the upper and lower bearing chocks 52***a*, 54*a* may be separated one from the other by spring-loaded or elastomeric devices.

The upper bearing chocks 52*a* have packers 60 which include one or more shims. The packers 60 are arranged to contact abutments in the form of partly cylindrical rocker plates 62 on the bridging portions 44. The lower bearing chocks 54*a* are similarly provided with packers 64.

Figure 6:
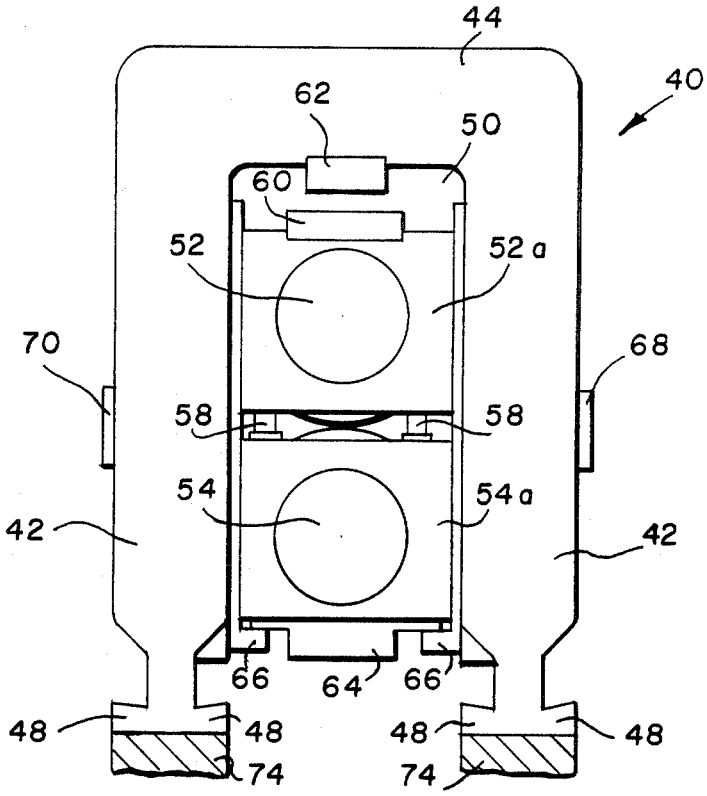
FIG. 6 is an end view of the housing in the position shown in FIG. 3.

The work rolls 52, 54 together with their associated bearing chocks 52*a*, 54*a* and packers 60, 64 comprise "roll packages" which are receivable in the housing 40 through the housing windows 50. When the roll packages are in other than their rolling positions, as for example when they are loosely contained in the housing as shown in FIG. 6, the packers 64 of the lower chocks 54*a* rest on chock stops 66 protruding inwardly from the housing legs 42, and the packers 60 of the upper chocks 52*a* are spaced beneath the rocker plates 62. Entry and delivery guides 68, 70 are mounted on rest bars 72 extending between the housing ends.

Prior to being moved into an operative position on the rolling line, a housing is first prepared by having a fresh roll package inserted therein, and by having its entry and delivery guides mounted on the rest bars and preset. The thus prepared housing is then located adjacent to the rolling line on support rails 74. The lower bridge 14 is then shifted laterally from right to left as viewed in FIGS. 2 and 3 until it abuts the support rails 74, with the bottoms 22 of the channels 16 forming continuations of the rails 74. The housing 40 is then slid from the support rails onto the lower bridge, and the pistons 20' of the tightening cylinders 20 are hydraulically extended to raise the housing in relation to the lower bridge until the ribs 48 contact the undercut portions 18 of the channels 16. This positively locks the housing on the lower bridge, and also prestresses the housing/bridge interface.

The pistons of the separating cylinders 58 are then extended to press the upper roll chock packers 60 against the rocker plates 62. The pistons 24' of the roll positioning cylinders 24 are then hydraulically extended to contact and elevate the lower roll chock packers 64 off of the chock stops 66. The final location of the upper roll 52 will be determined by the number of shims making up the upper packers 60. The location of the lower roll 54 will be determined by the extent to which the pistons 24' of the roll positioning cylinders 24 are extended, it being understood of course that the cylinders 24 have sufficient power to easily overcome the separating forces exerted by the smaller cylinders 58. Once rolling is underway, the roll positioning cylinders 24 may be adjusted automatically in order to control the dimensions of the product being rolled. Roll separating forces acting on the upper roll 52 will be opposed by the rocker plates 62, whereas the roll separating forces acting on the lower roll 54 will be opposed by the roll positioning cylinders 24.

When it becomes necessary to exchange housings, the pistons of the roll positioning cylinders 24 and the tightening cylinders 20 are retracted, with the result that the lower chock packers 64 and the housing legs 42 are respectively lowered onto the chock stops 66 and the bottom surfaces 22 of the base channels 16.

The separating cylinders 58 are locked in a semi-retracted position and are disconnected. However, as previously mentioned, the hydraulic circuit controlling cylinders 58 is separate from that controlling the roll positioning cylinders 24 and tightening cylinders 20. Thus, disconnection of cylinders 58 does not adversely affect hydraulic roll positioning.

Figure 3:
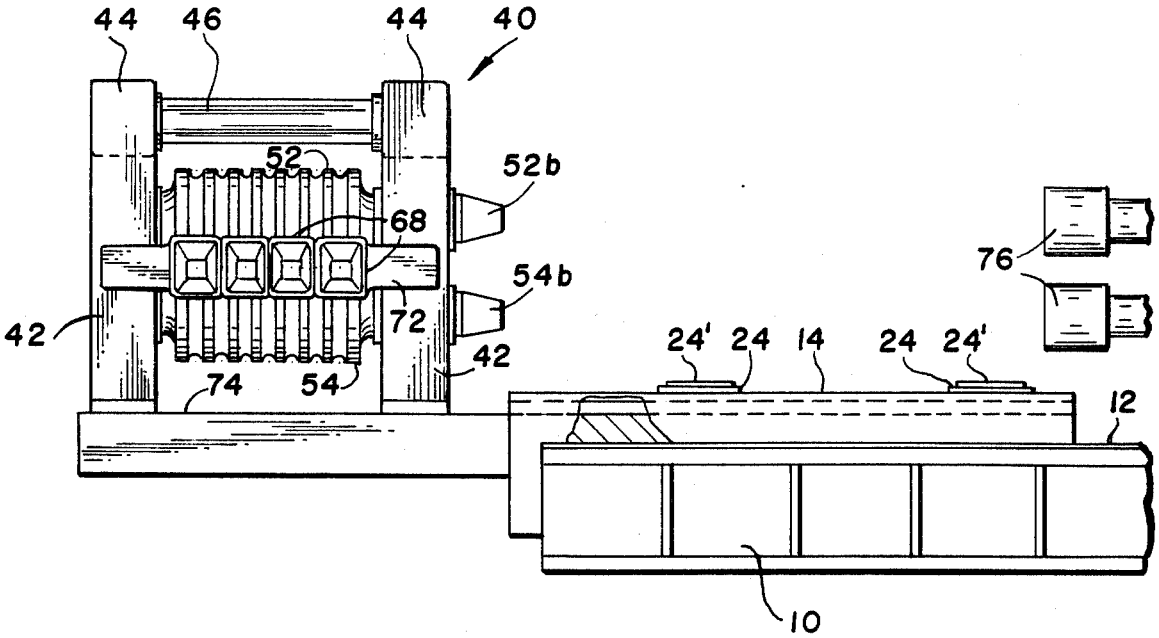
FIG. 3 is a view similar to FIG. 2, but in side elevation, and showing the roll housing removed from the rolling line.
Figure 5:
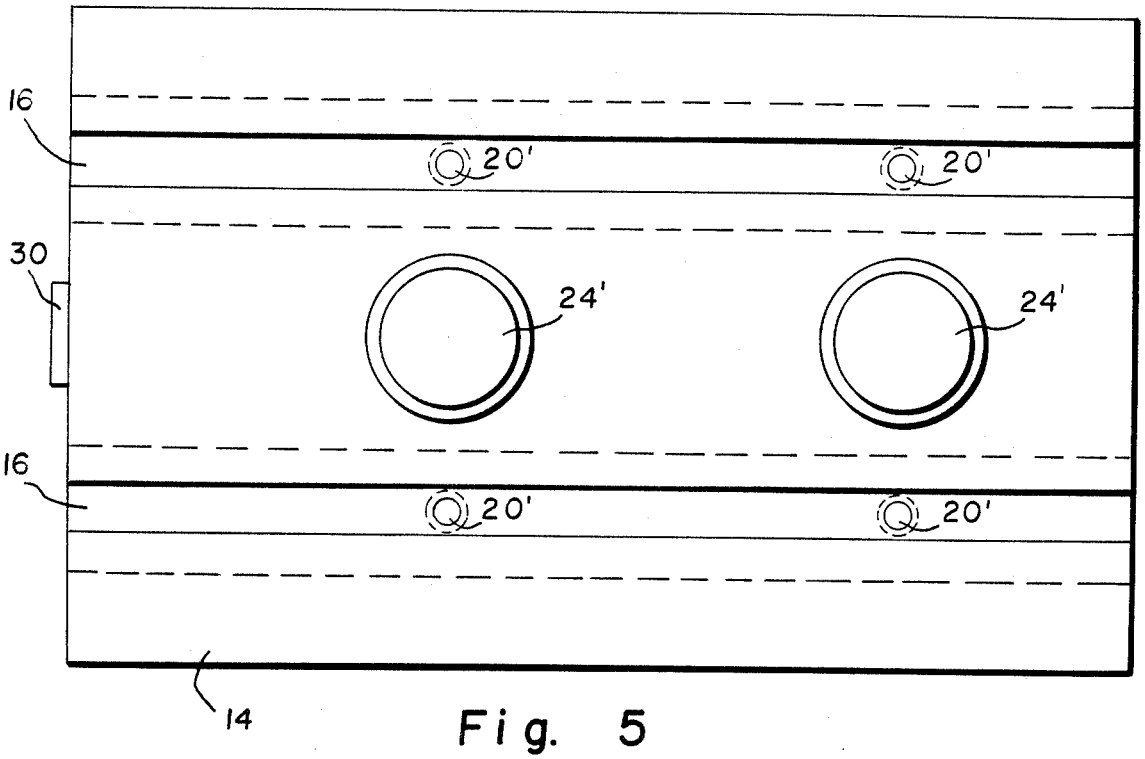
FIG. 5 is a plan view of the lower bridge as shown in FIG. 4.

The lower bridge 14 is then shifted from the rolling line to the rails 74, and the housing is removed to the position shown in FIG. 3. All this is accomplished without disturbing the roll positioning cylinders 24 and their connections to the remainder of the hydraulic control circuit.

During rolling, the lower bridge 14 may be shifted on the bed rails 12 to align different roll passes with the rolling line. The flexibility of the hydraulic lines 32, 34 will accommodate such shifting. The work rolls 52, 54 have neck extensions 52*b*, 54*b* adapted to be received in couplings 76 on the ends of conventional axially and angularly adjustable drive spindles.

Under certain circumstances, it may be desirable to do away with the tightening cylinders 20, and instead to rely on enlarged separating cylinders 58 to accomplish the same function. In this event, the roll positioning cylinders 24 would be actuated first to elevate the lower chock packers 64 from the chock stops 66. Thereafter, the separating cylinders 58 would be actuated to push the upper chock packers 60 against the rocker plates 62 and to raise the housing 40 until the ribs 48 engage the undercut surfaces 18 of the base channels 16.

FIGS. 7–10 illustrate how the present invention may be employed in connection with vertical rolling mill roll stands. Here, a mill support 78 has vertical rails 80 located to one side of the rolling line. A side bridge 82 has edge grooves 84 (see FIG. 9) engageable with the vertical rails 80. The side bridge has a shelf 86 supporting a vertically depending threaded shaft 88. The threaded shaft 88 is engaged by a nut 90 rotatably driven via a gear box 92 by a reversible electric drive motor 94. The gear box 92 and motor 94 are supported on a shelf 96. The side bridge 82 may be raised and lowered on the vertical guide rails 80 by appropriate operation of the motor 94.

The side bridge 82 has vertically spaced raised portions 98*a*, 98*b* with parallel undercut channels 100*a*, 100*b* facing the rolling line. The channels 100*a* extend vertically from top to bottom through raised portions 8*a*, whereas the channels 100*b* extend downwardly to horizontal ledges 102. Roll positioning cylinders 104 are located in the raised bridge portions 98*a*, 98*b* centrally between the channels 100*a*, 100*b*. Because of the horizontal attitude of the cylinders 104, they are preferably of the double acting type, as opposed to the single acting vertically arranged cylinders 24 in the embodiment illustrated in FIGS. 1–6.

The side bridge 82 carries a vertical roll housing 106 similar in construction to the horizontal roll housing 40 of FIGS. 1 to 6. Housing 106 has U-shaped ends each having laterally spaced legs 108 joined by bridging portions 110. The housing ends are interconnected by separators 112 extending between the bridging portions 110. The ends of the legs 108 are slidably interlocked in the undercut channels 100*a*, 100*b*.

The housing 106 is adapted to contain a vertical roll package comprising work rolls 114, 116, the ends of which are rotatably supported in bearings contained in bearing chocks 114*a*, 116*a*. Separating devices 118 between the chocks 114*a*, 116*a* operate to maintain a gap between the work rolls. The chocks 114*a* have packers 120 contacting rocker plates 122 on the bridging portions 110. Chocks 116*a* have packers 124 contacted by the pistons 104' of the roll positioning cylinders 104.

The cylinders 104 act in conjunction with the separating devices 118 to control the gap between the work rolls 114, 116. The cylinders 104 are connected by conduits (not shown) in the side bridge 82 to a valve control panel 126, which in turn is connected by flexible hydraulic fluid feed and return lines to a pump and reservoir (not shown), much in the same manner as described previously in connection with the embodiment illustrated in FIGS. 1–6. The usual entry and delivery guides 128, 130 are again mounted on rest bars extending between the legs 108, and the work rolls 114, 116 have neck extensions 132 adapted to be removably received in couplings 134 on the ends of vertical drive spindles 136.

Figure 10:
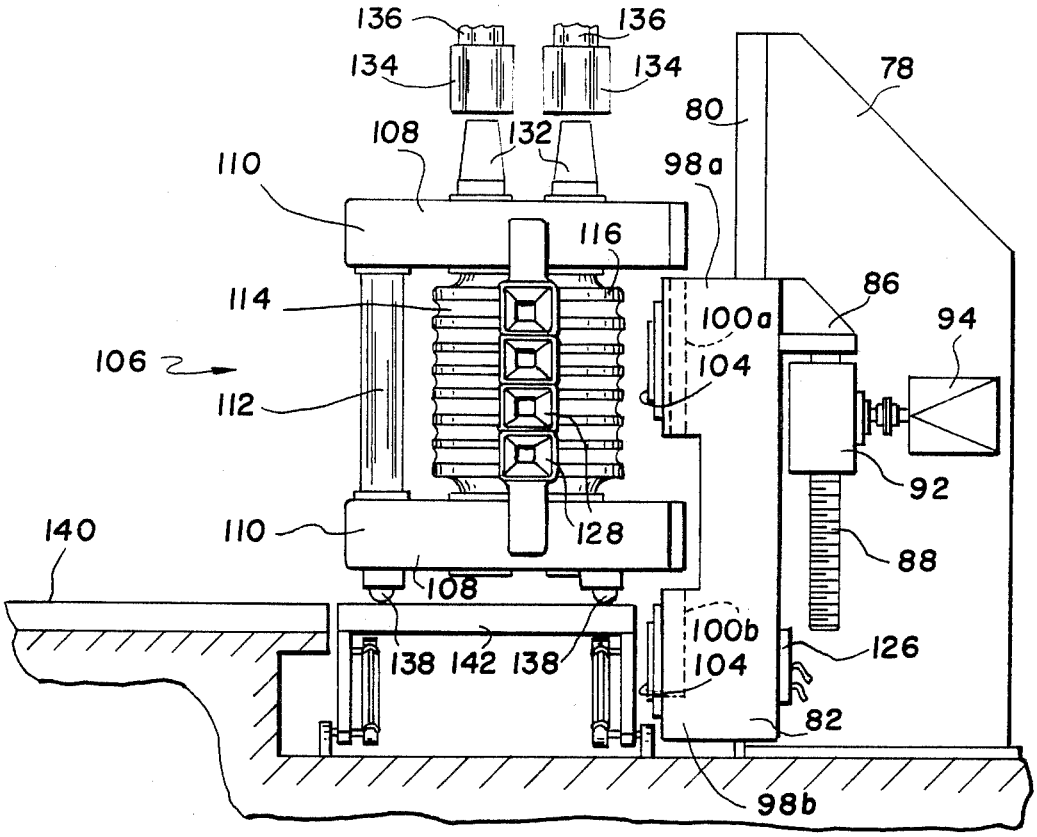
FIG. 10 is a view similar to FIG. 7 showing the housing disconnected from the lower bridge.
Figure 7:
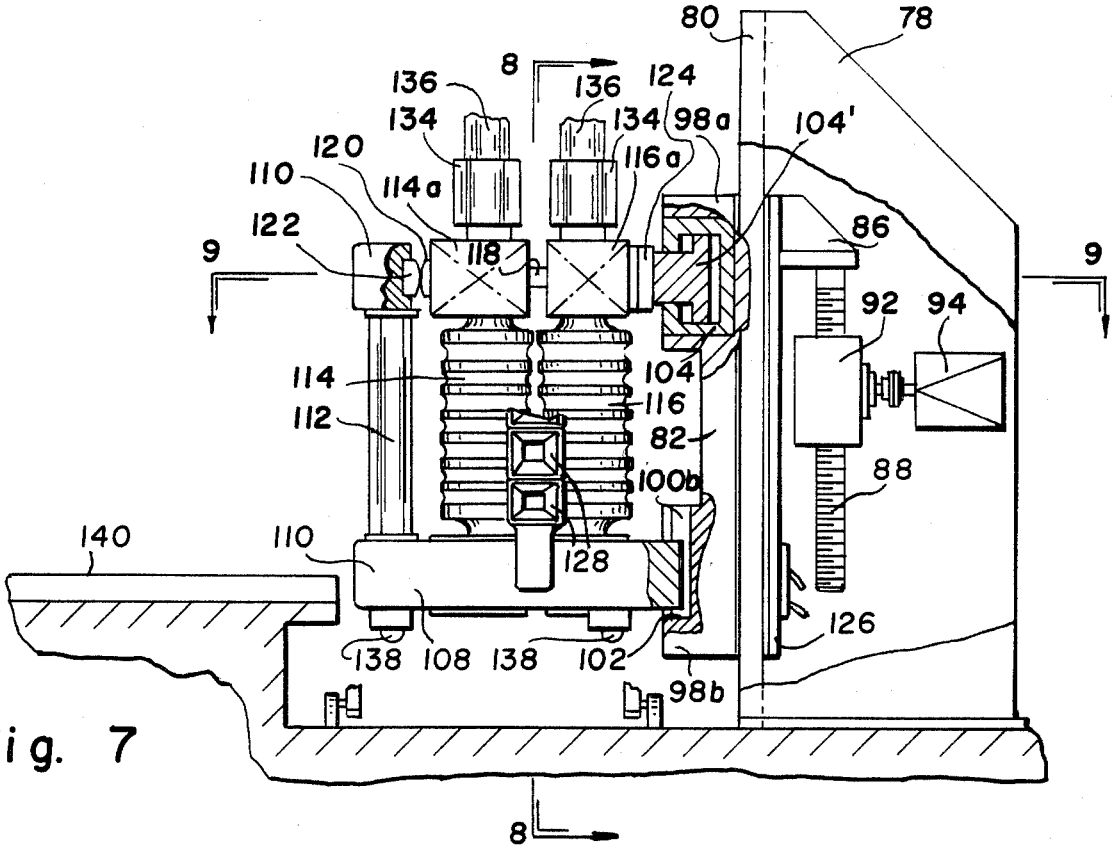
FIG. 7 is a view, with portions broken away, of a vertical rolling mill roll stand in accordance with the present invention.
Figure 8:
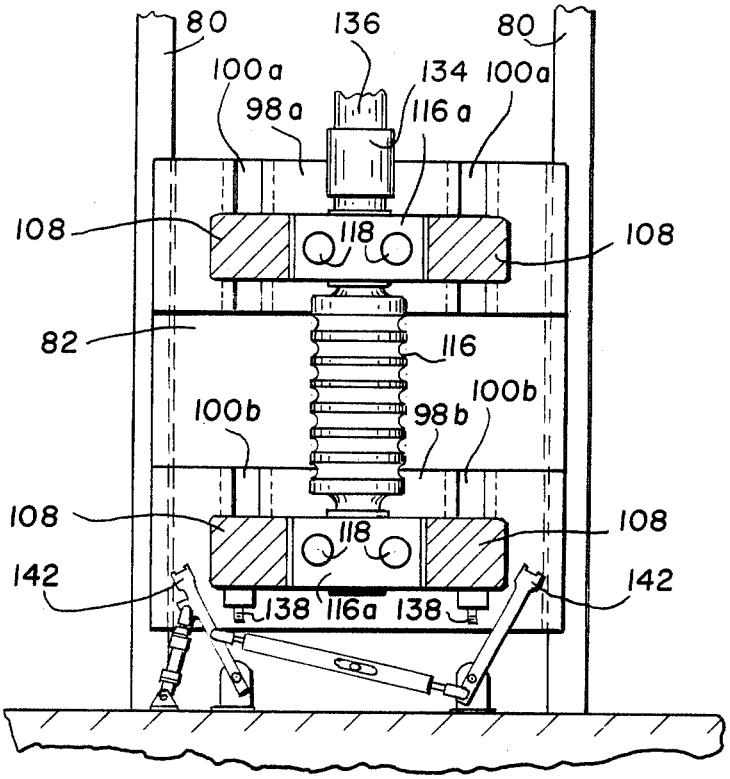
FIG. 8 is a sectional view taken along line 8—8 of FIG. 7.
Figure 9:
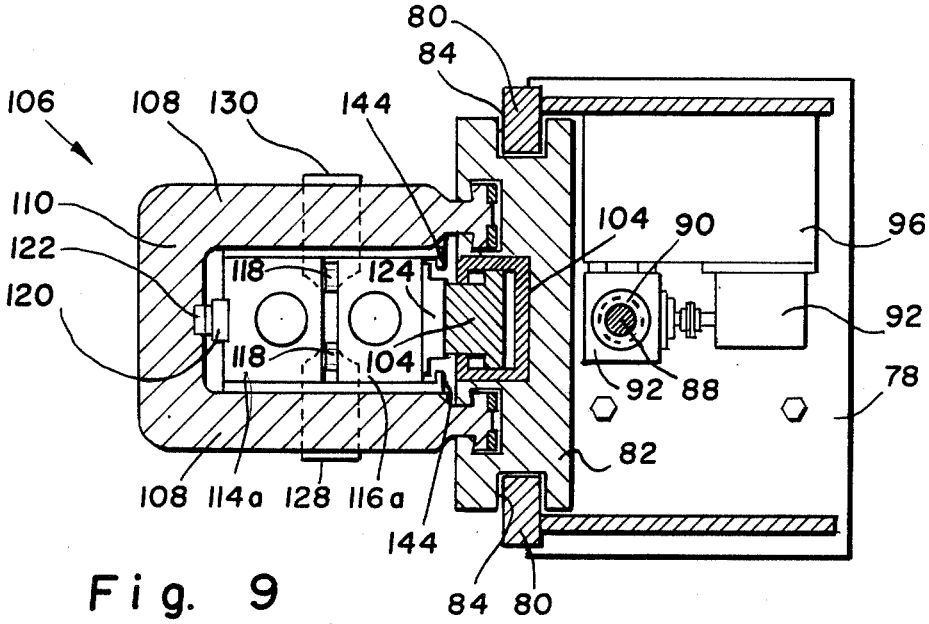
FIG. 9 is a sectional view taken along line 9—9 of FIG. 7.

When it becomes necessary to exchange housing 106 for another housing equipped with a fresh roll package and guides, the side bridge 82 is initially elevated to a level such that wheels 138 on the lowermost housing legs 108 are above the level of horizontal support rails 140. Pivotal rails 142 are then moved from their retracted positions best shown in FIG. 8 to their raised positions at the level of support rails 140, as shown in FIG. 10. Thereafter, the side bridge 82 is lowered until the wheels 138 come to rest on the rails 142. The pistons 104' of the roll positioning cylinders 104 are then retracted from the packers 124 on chocks 116*a*, allowing the separating devices 118 to expand until the packers 124 engage chock stops 144.

The side bridge 82 is then lowered to the position shown in FIG. 10, which results in the housing legs 108 being slidably disengaged from the undercut channels 100*a*, 100*b*. At this point, the housing 106 is free of the side bridge 82, and it can be moved from rails 142 onto rails 140 for removal. A replacement housing can then be moved back onto rails 142 and reconnected to the side bridge 82 by reversing the foregoing steps.

Here again, as one roll housing is interchanged for another, the roll positioning cylinders 104 remain undisturbed, as does their connection via valve control panel 126 to the remainder of the hydraulic control circuit.

I claim:

1. A rolling mill roll stand comprising: a housing removably mounted on a bridge; a pair of work rolls and their respective bearings and bearing chocks contained by said housing; separating means acting on said bearing chocks to maintain a gap between said work rolls; and hydraulic roll positioning means carried on said bridge and arranged to act on the bearing chocks of one of said work rolls in opposition to the roll separating forces acting on said one work roll, the roll separating forces acting on the other of said work rolls being opposed by said housing; said housing together with said work rolls bearing chocks and separating means being removable as a unit from said bridge while allowing said hydraulic roll positioning means to remain undisturbed.

2. A rolling mill roll stand comprising:

a bridge;

a housing carried by said bridge;

first and second work rolls rotatably supported by bearings contained in bearing chocks, said work rolls and their respective bearings and bearing chocks being adapted to be received in said housing;

separating means interposed between the bearing chocks of said first and second work rolls for maintaining a gap between said work rolls;

abutment means on said housing, said abutment means being arranged to act on the bearing chocks of said first work roll in opposition to the roll separating forces generated during a rolling operation; and hydraulic positioning means carried on said bridge, said positioning means being hydraulically connected to and operated by a hydraulic control system and being arranged to act on the bearing chocks of said second work roll in opposition to said roll separating forces, said housing being removably interlocked with said bridge in a manner such that said housing together with said work rolls, bearings and bearing chocks and separating means may be removed as a unit from said bridge while allowing said hydraulic positioning means to remain on said bridge with the hydraulic connection thereof to said control system undisturbed.

3. The rolling mill roll stand of claim 2 wherein the interlocked portions of said bridge and said housing are mutually engageable at load interfaces, and wherein means are provided for hydraulically preloading said housing in relation to said bridge in order to tighten said load interfaces.

4. The rolling mill roll stand of claim 3 wherein said means comprises hydraulic rams carried on said bridge and arranged to engage said housing.

5. The rolling mill roll stand of claim 3 wherein said means comprises said separating means acting in concert with said positioning means.

6. The rolling mill roll stand of claim 5 wherein said separating means comprises hydraulic rams.

7. The rolling mill roll stand of claim 2 wherein said bridge and said housing are movable in relation to each other into and out of interlocked engagement in a direction parallel to the axes of said work rolls.

8. The rolling mill roll stand of claim 7 wherein said work roll axes extend horizontally, and wherein said housing is removable from said base onto horizontally extending rail members located to one side of said bridge.

9. The rolling mill roll stand of claim 8 wherein said bridge is mounted on an underlying stationary bed, and said bridge is shiftable on said bed between a rolling position spaced from said rail members and a change position directly adjacent to said rail members.

10. The rolling mill roll stand of claim 7 wherein said roll axes extend vertically, and wherein horizontal guide rails are arranged to support said housing during movement of said bridge into and out of interlocked engagement therewith.

11. In a rolling mill roll stand having work rolls and associated bearings and bearing chocks received in a housing, with the roll separating forces generated during rolling being at least partially opposed by hydraulic positioning means acting on the bearing chocks of one of said rolls, the hydraulic positioning means being hydraulically connected to and operated by a hydraulic control system, the improvement comprising: said hydraulic positioning means and said housing being carried on a bridge, and said housing being removably interlocked with said bridge in a manner such that a unit consisting of at least said housing and said work rolls and their associated bearings and bearing chocks may be removed from said bridge without disturbing the location of said hydraulic positioning means or the hydraulic connection thereof to said hydraulic control system.

* * * * *